US007832025B2

(12) United States Patent
Virica et al.

(10) Patent No.: US 7,832,025 B2
(45) Date of Patent: Nov. 16, 2010

(54) DISPENSER FOR RELEASING TREATMENT COMPOSITION INTO A TOILET BOWL

(75) Inventors: Peter Virica, Newcastle-upon-Tyne (GB); Neil Papworth, Norfolk (GB); Brian Wilson, Norfolk (GB)

(73) Assignee: Jeyes Group Limited (GB)

( * ) Notice: Subject to any disclaimer, the term of this patent is extended or adjusted under 35 U.S.C. 154(b) by 750 days.

(21) Appl. No.: 10/599,241

(22) PCT Filed: Mar. 24, 2005

(86) PCT No.: PCT/GB2005/001194

§ 371 (c)(1),
(2), (4) Date: Nov. 20, 2006

(87) PCT Pub. No.: WO2005/093176

PCT Pub. Date: Oct. 6, 2005

(65) Prior Publication Data

US 2008/0086801 A1 Apr. 17, 2008

(30) Foreign Application Priority Data

Mar. 24, 2004 (GB) ..... 0406616.3

(51) Int. Cl.
*E03D 9/03* (2006.01)

(52) U.S. Cl. ..... 4/227.4; 4/228.1; 4/231

(58) Field of Classification Search ..... 4/227.4, 4/228.1, 231, 222, 223, 431, 227.6; 510/191
See application file for complete search history.

(56) References Cited

U.S. PATENT DOCUMENTS

| | | | | |
|---|---|---|---|---|
| 1,067,472 | A | 7/1913 | Creed | |
| 1,091,265 | A | 3/1914 | Wohlander | |
| 3,504,384 | A * | 4/1970 | Fraser et al. | 4/227.6 |
| 4,555,819 | A | 12/1985 | Weiss et al. | |
| 4,670,916 | A | 6/1987 | Bloom | |
| 4,891,388 | A * | 1/1990 | Graiver et al. | 521/64 |
| 6,311,340 | B1 * | 11/2001 | Thompson | 4/231 |
| 2004/0094635 | A1 * | 5/2004 | Harris et al. | 239/60 |
| 2004/0221378 | A1 * | 11/2004 | Conway et al. | 4/231 |
| 2005/0014669 | A1 * | 1/2005 | Weerawarna et al. | 510/302 |

FOREIGN PATENT DOCUMENTS

| | | |
|---|---|---|
| EP | 1 522 319 | 4/2005 |
| EP | 1 522 319 A | 4/2005 |
| WO | WO 98/17243 | 4/1998 |
| WO | WO 02/066084 | 8/2002 |
| WO | WO 03/042462 | 5/2003 |
| WO | WO 03/042462 A | 5/2003 |
| WO | WO 2005/001212 | 6/2005 |

OTHER PUBLICATIONS

International Search Report for PCT/GB2005/001194.
International Search Report PCT/GB2005/00194 Dated Jun. 30, 2005 (European Patent Office).

* cited by examiner

*Primary Examiner*—Gregory L Huson
*Assistant Examiner*—Karen Younkins
(74) *Attorney, Agent, or Firm*—Ostrolenk Faber LLP

(57) ABSTRACT

A dispenser for releasing a treatment composition into the bowl of a toilet, and a fragrance into the surrounding room, comprises a solid block of a treatment composition in a housing. A block of gel material impregnated with the fragrance fills an opening in a front wall of the housing and is exposed to the housing interior.

22 Claims, 4 Drawing Sheets

DISPENSER FOR RELEASING TREATMENT COMPOSITION INTO A TOILET BOWL

CROSS REFERENCE TO RELATED APPLICATION

The present application is a 35 U.S.C. §§371 national phase conversion of PCT/GB2005/001194, filed 24 Mar. 2005, which claims priority of Great Britain Application No. 0406616.3, filed 24 Mar. 2004. The PCT International Application was published in the English language.

BACKGROUND OF THE INVENTION

This invention relates to a dispenser for releasing a treatment composition into a toilet bowl, and also for releasing fragrance into the surrounding room. It also relates to a method of manufacture of such a dispenser.

Chemical compositions for treating the water in a toilet bowl, for example for cleaning the bowl, disinfecting it, or reducing lime scale build up, are well known, and may be dispensed from a solid block of the composition material. Further, gels or other solid vehicles for fragrance compositions are used in toilets to provide regular dispensing of a fragrance into the toilet room, over a protracted period. It is also known, for example from WO 03/042462 to provide a dispenser both for the treatment composition and also for the fragrance composition. The two types of composition are contained in separated chambers in a housing which hangs from the rim of the toilet. Once the toilet is flushed, water falls from the toilet rim into the bowl and some of the water flows through the housing, dissolving some of the treatment composition in its chamber. The treatment composition is thus dispensed periodically, whenever the toilet is flushed. The fragrance is allowed to permeate into the room continuously, and the housing is positioned to protect the fragrance containing gel from the flushing water.

SUMMARY OF THE INVENTION

One aim of the present invention is to provide a dispenser for treatment composition and for fragrance, with a simple construction which may be manufactured easily and provide improved performance.

Accordingly, one aspect of the present invention provides a dispenser for releasing a treatment composition into a toilet, and a fragrance into the surrounding room, comprising: a first block of the treatment composition; a second block of material impregnated with the fragrance; and a housing with apertures for admitting water into the housing and for allowing the water to drain out of the housing, and having an interior space to house the block of the treatment composition for contact with the water; the housing holding the fragrance block such that the fragrance block plugs an opening in a wall of the housing and allows one major surface of the fragrance block to be exposed to the exterior of the housing and an opposed major surface of fragrance block to be in fluid communication with the interior space of the housing to allow it to emit fragrance through the housing apertures.

By allowing the inner surface of the fragrance block to communicate with the atmosphere through the apertures, the effective surface area from which the fragrance evaporates is nearly doubled, compared with arrangements in which only one surface is exposed. Further, by allowing the fragrance block to be in communication with the interior of the housing, there is no need for a barrier between two chambers of the housing, as is considered necessary in WO 03/042462.

To facilitate holding of second block the housing may be a hollow shell and the wall opening have a flange extending inwardly of the shell, the flange supporting an edge of the fragrance block between its opposed major surfaces. The flange may have a projection extending into the opening for locating the fragrance block. The flange may have projections extending inwardly of the housing beyond the inner major surface of the fragrance block, for spacing it apart from the treatment composition block.

The wall opening may be in one side of the housing which is upright in use, and the apertures for admitting water and allowing it to drain may be separated from the wall opening so that the fragrance block is not in the direct flow path of water between those apertures. This reduces the likelihood of fragrance being washed into the flush water. With the wall opening in one side of the housing which is upright in use, and the apertures for admitting water and allowing it to drain separated from the wall opening, the flange can shield the edge of the fragrance block from the water.

A hanger may be provided, joined to the housing for removably hanging it from a rim of a toilet bowl.

The hanger may be joined to the housing at a wall which supports the fragrance block.

The housing may have internal plinth formations for supporting a base of the treatment block in use to allow the flow of water underneath it.

The fragrance block and the wall opening may have an irregular outline shape. The fragrance block may be formed with a decorative pattern on its outer major surface. The fragrance block may be formed of materials of two or more contrasting colours to form a visible pattern on its outer major surface.

The housing may be a plastics one-piece moulding. The housing may be formed from a hinged clam-shell one-piece plastics moulding, one portion of which consists of the wall plugged by the fragrance block.

In a particular aspect of the invention, the fragrance block comprises a gel.

The gel may comprise a polymer matrix having the fragrance dispersed therein.

The gel may be formulated to plug the wall opening and shrink as the fragrance evaporates but continue to plug the wall opening.

The treatment composition forming the first block may comprise one or more of a colourant, a surfactant and a bleach.

The dispenser may be produced by moulding the fragrance material into the wall opening.

The housing may be formed from a hinged clam-shell one-piece plastics moulding, one portion of which consists of the wall plugged by the fragrance block, the clam-shell moulding is then closed around the fragrance block, about its hinge, to secure it together.

Another aspect of the invention provides a dispenser for releasing a treatment composition into the bowl of a toilet, and a fragrance into the surrounding room, comprising: a first block of the treatment composition a second block of material impregnated with the fragrance; and a housing configured externally to be hung, in use, from the rim of the toilet, and with apertures for admitting water into the housing when the toilet is flushed and for allowing the water to drain out of the housing into the bowl, and having an interior space to house the block of the treatment composition for contact with the water; the housing holding the fragrance block such that the fragrance block plugs an opening in a wall of the housing and allows one major surface of the fragrance block to be exposed to the exterior of the housing and an opposed major surface of fragrance block to be in fluid communication with the interior space of the housing to allow it to emit fragrance through the housing apertures.

Other preferred features and advantages of the invention will be apparent from the accompanying claims and the following description.

BRIEF DESCRIPTION OF THE DRAWINGS

In order that the invention may be better understood, preferred embodiments thereof will be now described, by way of example only, with reference to the accompanying drawings, in which.

DESCRIPTION OF A PREFERRED EMBODIMENT

Figure 1:
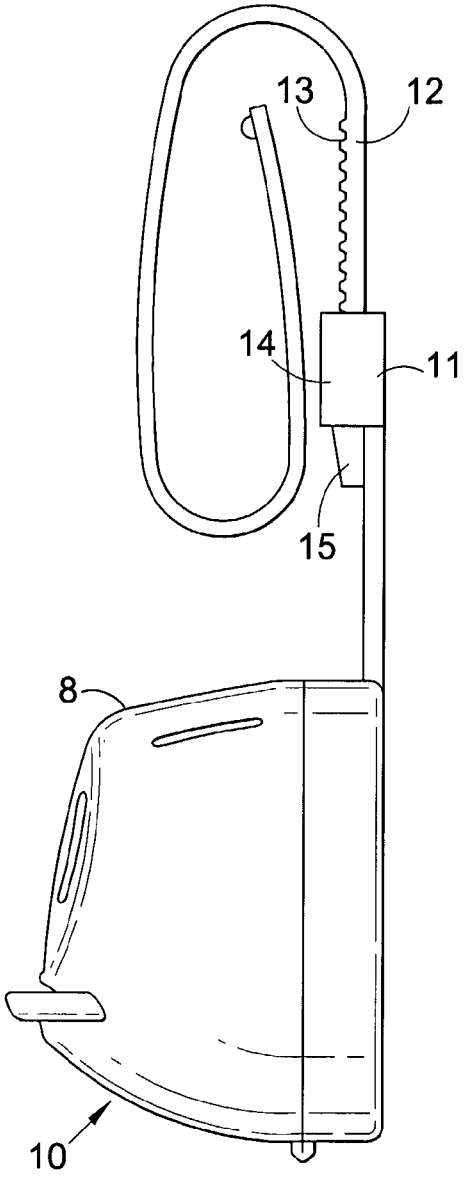
FIG. 1 is a side view of a dispenser embodying the invention.
Figure 2:
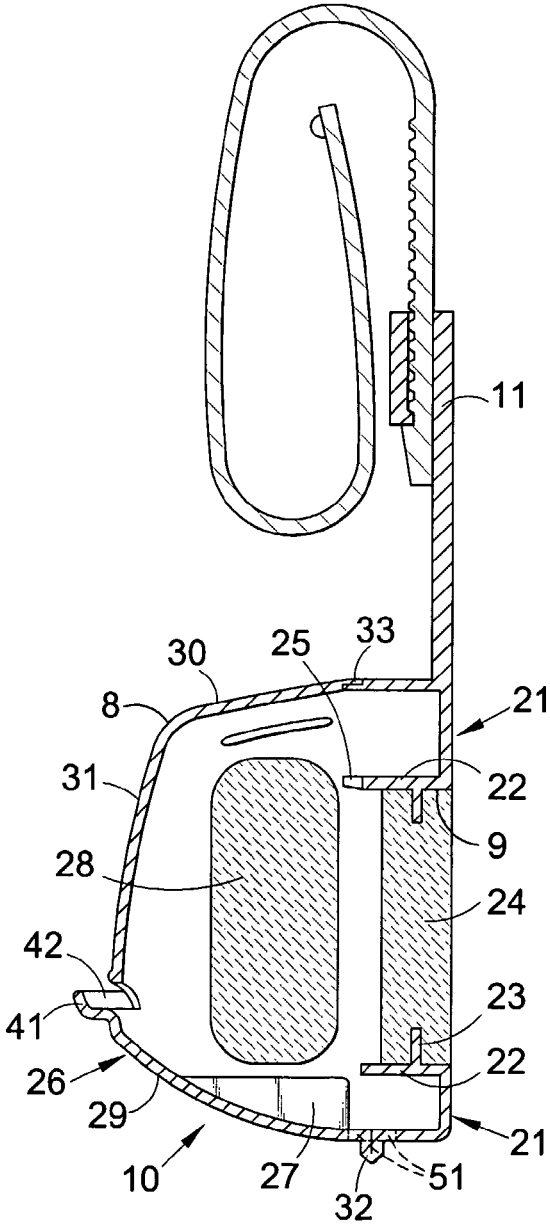
FIG. 2 is a vertical cross-section through the dispenser of FIG. 1.
Figure 3:
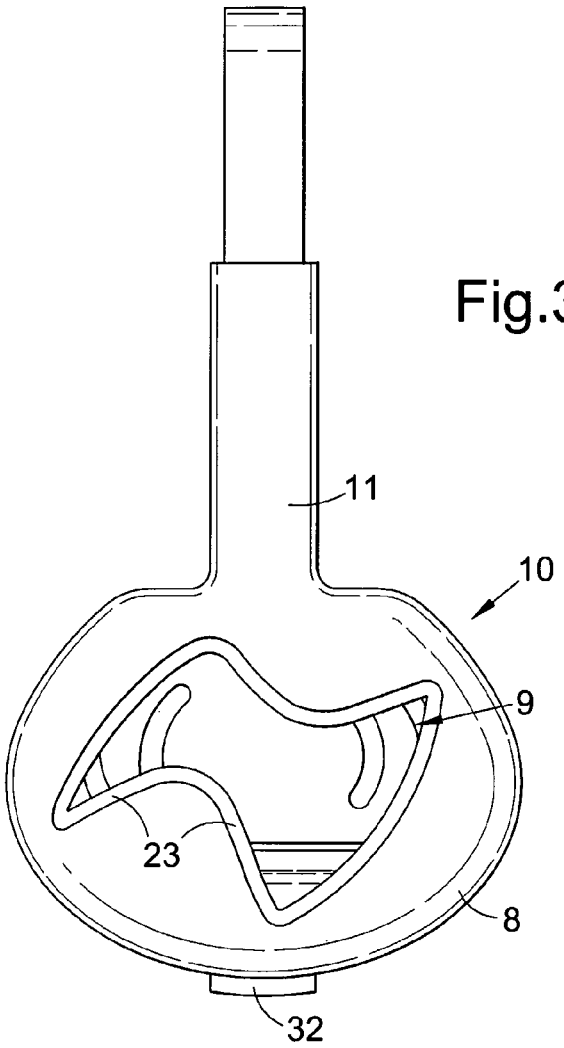
FIG. 3 is a front view of the dispenser of FIG. 1.
Figure 4:
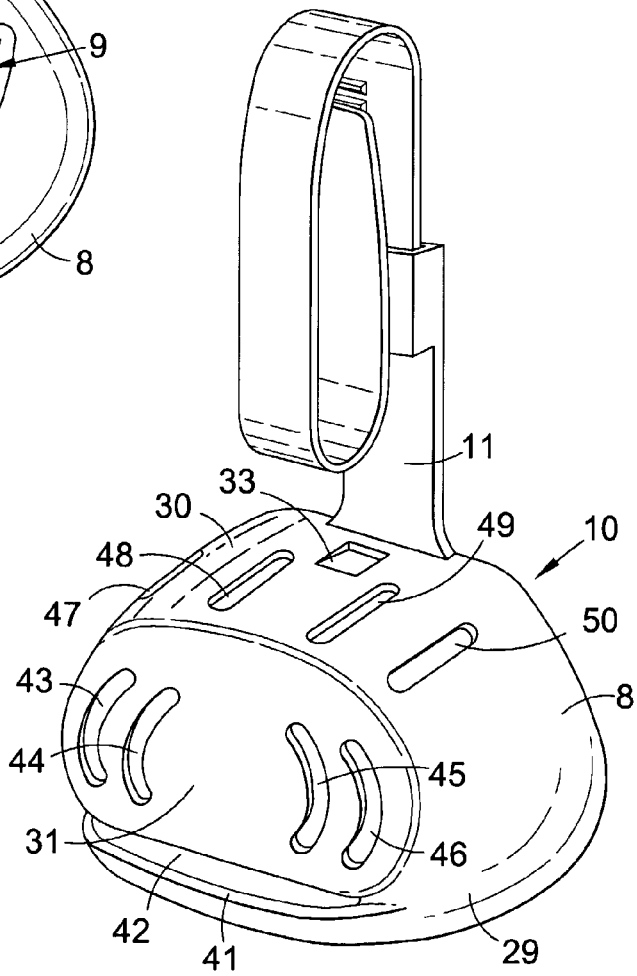
FIG. 4 is a perspective view from the rear and one side, of the dispenser of FIG. 1.

A dispenser 10 consists of a hollow housing 8 connected to a hanger 12. The hanger is shaped in the form of a coil to be removably hung from the rim of a toilet, so that the housing 8 hangs downwards as shown in FIGS. 1 to 4. It grips the rim by resilient deformation of the coil as well known. A leg portion 11 formed integrally with the housing, and projecting radially from a front face 21 of the housing, has a socket 14 which receives one end of the coil-shaped hanger 12 of which a tip 15 is tapered for easy insertion. A line of notches 13 allows vertical adjustment of the hanger 12 within the socket 14, to allow adjustment of the vertical length to suit toilets of different shape. The function of the hanger is to place the housing directly into the flow of water into the toilet bowl when the toilet is flushed. As shown in FIG. 2, in cross-section view, the housing has a flat front face 21 connected to a rear bowl 26 comprising a curved sidewall 29 with a flattened upper portion 30, and a slightly curved rear wall 31. As shown more clearly opened out in FIG. 5, the housing is formed from a one piece plastics moulding in the form of a clam shell, hinged at 32, and closed with a snap fit by inter-engaging formations 33 on the two clam shell halves. As shown in FIGS. 2 and 4 most clearly, the housing has a rearwardly projecting lip 41 forming a scoop or trough with an upwards facing opening slot 42, for trapping water travelling downwardly from the rim. Such water is guided into the housing which then is allowed to fill. For US style systems in which the flush water flows down the surface of the toilet bowl, the housing may be positioned with the lip 41 against the bowl surface. The lip may be extended outwards to facilitate this. Further, a row of four arcuate slots 43,44, 45 and 46 is provided in the rear vertical face 31, for admitting flushing water into the housing. Further still a row of four straight apertures 47, 48, 49 and 50 is provided along the upper wall 30 of the housing, for admitting flushing water.

A pair of small apertures 51 are provided adjacent the hinge 32 at the base of the housing, for allowing water to drain slowly from the housing once flushing is complete. Such water will contain a dissolved portion of the treatment composition which is held in a solid block 28 within the housing. In this example, the small apertures 51 are formed by unshaped notches 51*a* and 51*c* in the edge of the rear portion of the clam shell moulding, which cooperate with corresponding notches 51*b* and 51*d* in the other clam shell half, as shown in FIG. 5.

Figure 5:
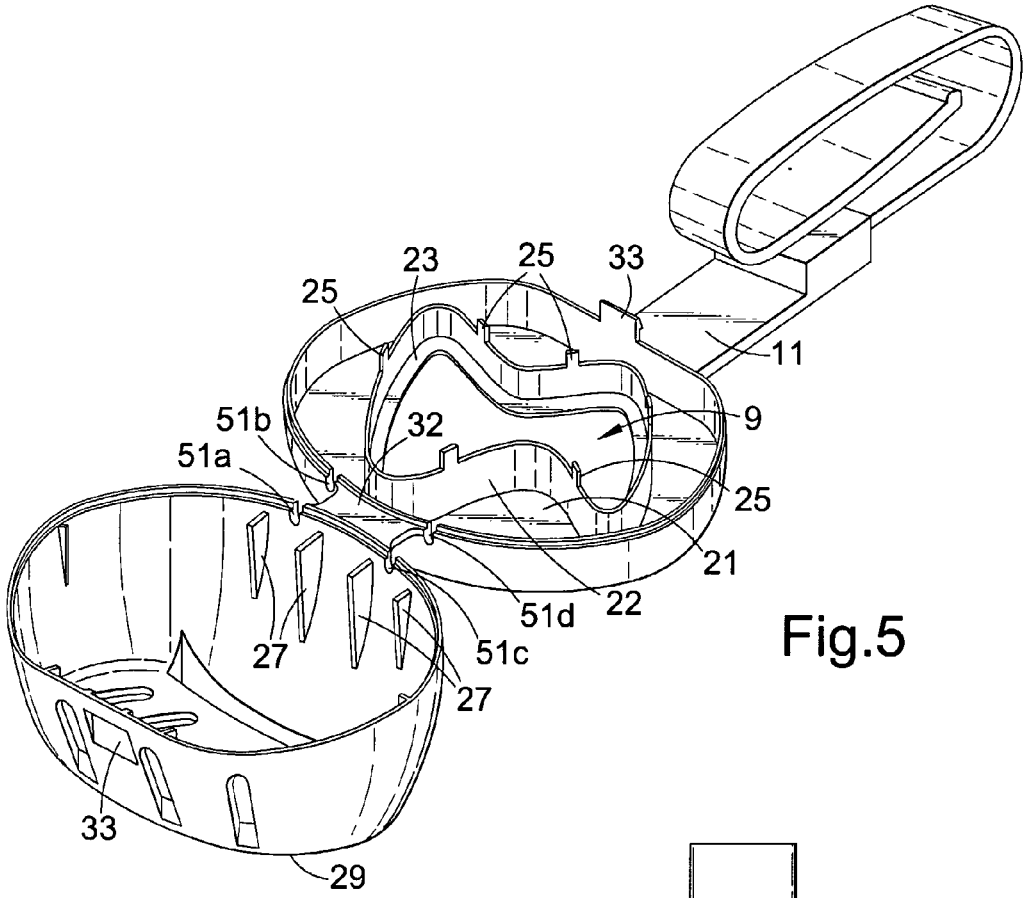
FIG. 5 is a perspective view of a plastics moulding before it is folded into the configuration shown in FIG. 1.
Figure 6:
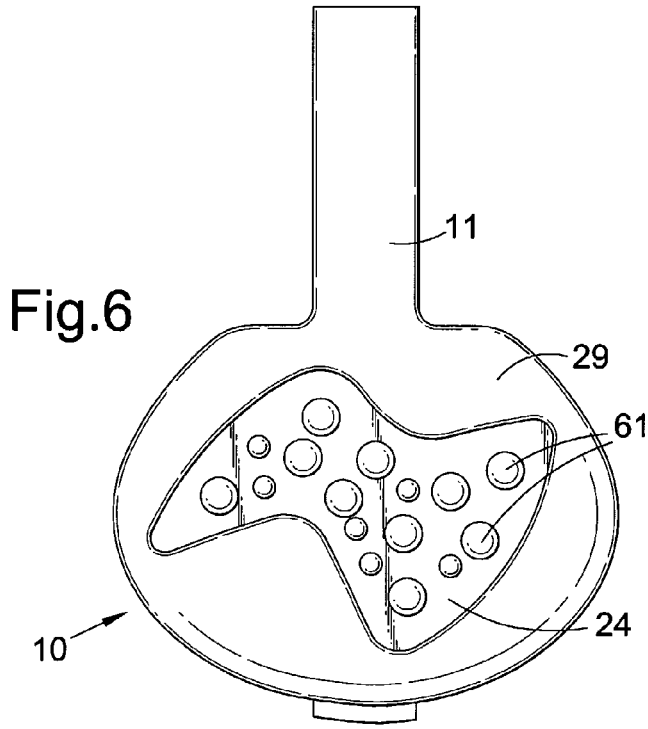
FIG. 6 is a perspective view from the front of part of the dispenser of FIG. 1, showing a patterned fragrance block.

The interior of the lower wall 26 of the housing is formed with a series of four parallel plinth projections 27, shown in FIGS. 2 and 5, for supporting the treatment block 28 and allowing the flow of water beneath it. To the rear, the treatment block 28 will abut against the inner surface of the housing. To the front, the treatment block 28 is held away from a fragrance block 24 by a series of castellations 25, typically 1 to 4 mm in height, shown in FIGS. 2 and 5, formed as inward projections on a flange 22 which extends inwardly from an opening in the front wall 21. The castellations 25 serve to space the front surface of the treatment block 28 from the fragrance block 24 which fills or plugs the aperture 9 in the front wall 21, as shown in FIGS. 2 and 6. This allows water to flow around the entire surface of the treatment block 28, and to touch the rear surface of the fragrance block 24, and allows fragrance to evaporate from the rear face of the block 24, interior of the housing.

As shown most clearly in FIGS. 2 and 5, the flange 22 extends inwardly transverse to the front face 21 of the wall, and supports and protects the edge of the fragrance block 24 between its two opposed major surfaces. A shoulder or ledge 23 extends inwardly from the flange 22, parallel to the front surface 21 of the wall, for locating the fragrance block 24. Flange 22 may be continuous or may be a series of short lengths or spikes. A continuous flange is preferred to maintain contact with the edge of the fragrance block as or if it shrinks when the fragrance evaporates.

In this example, the housing is about 60 mm high by 60 mm wide by 40 mm deep and the hanger length is adjustable between about 50 mm and 80 mm.

A typical gel impregnated with fragrance, forming the fragrance block 24, will shrink, as the fragrance evaporates during use, by about 1 mm around its perimeter, in the radial direction. For this reason, the shoulder 23 has to be sufficiently wide to accommodate such shrinkage in use, whilst still retaining the gel block 24 and plugging the aperture. By way of comparison, the shrinkage from front to back of the gel block 24 may typically be less than 0.5 mm each side for a block which is 6 to 8 mm. thick. The degree of shrinkage will depend on the polymer matrix forming the gel, and the volume percentage of perfume in the gel.

The apertures in the housing are separate, transversely, from the vertical major surface or the fragrance block 24, but water will still cascade over the front face of the housing and the block 24 in turbulent flow toilet systems. The block may be in contact briefly with water trapped in the housing, which will contain dissolved constituents of block 28, but with appropriate choice of materials, such as a hydrophobic gel and fragrance for block 24, this exposure is insufficient to cause significant washing of fragrance composition into the water.

The composition of the treatment block may be one of those well known in the art and for example as described in WO 03/042462. Such compositions may include one or more of a colourant, a surfactant, a bleach or other disinfectant, and a limescale inhibitor or remover. A composition comprising a surfactant and/or a colourant is particularly preferred.

Preferred block formulations are, in % by weight:

EXAMPLE A

| | |
|---|---|
| Sodium Alkylaryl sulfonate (80%) | 40 |
| Sodium alpha-olefin sulfonate (80% active) | 20 |
| Coco monoethanolamide | 5 |
| Alcohol ethoxylate | 5 |
| Sodium sulfate | balance |

EXAMPLE B

| | |
|---|---|
| Sodium Alkylaryl sulfonate (80%) | 26 |
| Sodium alpha-olefin sulfonate | 12 |
| Sodium Secondary alkane sulfonate | 5 |
| Hydrophobes | 5 |
| Sodium sulfate | balance |

EXAMPLE C

| | |
|---|---|
| Sodium Alkylaryl sulfonate(80%) | 40 |
| Sodium alpha-olefin sulfonate | 20 |
| Coco monoethanolamide | 5 |
| Hydrophobes | 5 |
| Sodium sulfate | balance |

To maximise the active ingredients in the block the amount of hydrophobe is reduced, and the quantity of water entering the housing is limited by the size of the apertures in the housing wall to reduce the rate of solubilisation of the block.

When using a bleach containing block 28, the amount of bleach which needs to be contained in the block, and hence dissolved, can be minimised by restricting the outflow of water from the housing so that the majority of the water in the housing will flow into the bowl after the bowl contents have been replenished by the flush water.

Suitable fragrance containing gel formulations are as described in WO 02/066084, particularly at examples 1 to 7.

Preferred formulations have a range of 30% to 70% by weight fragrance in a polymer gellant such as ETPA (ester terminated polyamide) as in WO 98/17243 or ATPA. About 50% by weight ETPA or ATPA polymer gellant and 50% by weight fragrance oil with a colourant is particularly preferred.

The required rigidity of the gel will depend in part on the size of the aperture in the housing wall. Thus a sinuous outline to the aperture is preferred to provide a large area but maintain a smaller span in at least one direction across the aperture. The aperture may be spanned by supporting ribs which may be encased within the gel body or be exposed to provide a part of the decorative effect. A honeycomb or grid type structure may also be provided for gels which are less self supporting.

As shown in FIGS. 5 and 6, the outline of the aperture in the front wall 21 is of an irregular shape, in this case a "swirl" which is intended to add aesthetic merit to the overall design. Further, the gel composition from which the fragrance block is made could for example include two or more different contrasting colours, formed in a colour pattern, for aesthetic effect. Further still, the outer surface may be embossed with a shape, such as the dimples 61 of different sizes, to provide a further aesthetic effect.

For more rigid gels, the gel may be formed with apertures in the gel, thus increasing the exposed surface area of the gel for more enhanced fragrance release.

The dispenser may be packaged in a blister pack of the type known for such toilet products. The dispenser is then clipped over the rim of the toilet, so that it hangs vertically, with the housing in line with the flow of water during flushing. The front face 21 faces inwards in the toilet. Whenever the toilet is then flushed, water passes into the housing and then drains slowly from the housing, the period of dwell of that water being sufficient to allow some of the treatment composition in the treatment block to be dissolved into the water. Due to the relatively short period, typically about 10 seconds after the initiation of the flushing, during which the treatment block is exposed to the water, only a limited, reasonably controlled amount is dissolved. Further, due to this relatively short period, the effect of any water contacting the inner surface of the fragrance block is minimal.

The inner surface of the fragrance block 24 is continuously exposed to the air in the housing, which allows fragrance vapour to emerge through the apertures into the room surrounding the toilet. At the same time, there is a continuous spread of vapour from the external surface of the fragrance block 24 into the room. Thus the effective surface area of the fragrance block is a large part of its total surface area, excluding the edge which is in contact with the flange 22.

In this example, the dispenser is intended to be disposable at end of life. This may be indicated by the disappearance of the block, or more easily by using a treatment block containing a dye or surfactant, the absence of colour or foam in the toilet bowl indicating the end of life. When the fragrance is depleted, it is preferred that the matrix of the fragrance block remain, plugging the aperture in the housing front wall.

The dispenser is manufactured as follows. The one-piece plastic moulding shown in FIG. 5 is produced by injection moulding substantially in the configuration shown in FIG. 5. It is then placed over a puck such that the puck engages the front face 21 of that clam shell half. The fragrance gel in liquid form is poured into the moulding chamber formed by the puck and the flange 22, with the level rising higher than the shoulder 23, to form the gel block 24 which is then allowed to solidify. Typically, the puck is polished and thermally conductive, preferably of aluminium, and preferably it has a raised boss approximately 1 mm high, complementary in shape with the aperture. By raising the surface, this ensures correct registration of the puck with the housing wall 21, and the gel is prevented from leaking during the moulding process. An alternative would be for the puck to have a recess engaged by a boss in the housing shell.

The puck may be embossed or otherwise formed to provide the required patterns in the surface of the gel block. A three dimensional surface to the gel will provide increased evaporation rate of the fragrance. Different nozzles may be provided for different colours of gel, to give a desired aesthetic effect by mixing colours. The puck may have upstands which extend through the thickness of the gel layer, to form through apertures in the moulded gel block.

Once the gel has set and the puck has separated from the clam shell, a treatment block is dropped into the rearward half shell 29, and the clam shell is closed by folding it about its hinge 32, until the inter-engaging formations 33 close it with a snap fit. The housing is then closed except for the apertures which admit water.

It will be appreciated that alternative materials may be used for the fragrance block, other than gels; the block however has to be sufficiently rigid to act as a plug for the aperture.

Further, the dispenser could adopt different shapes and configurations, and it need not have a hanger 12, for example if it could be wedged effectively under the toilet rim by other means.

Figure 7:
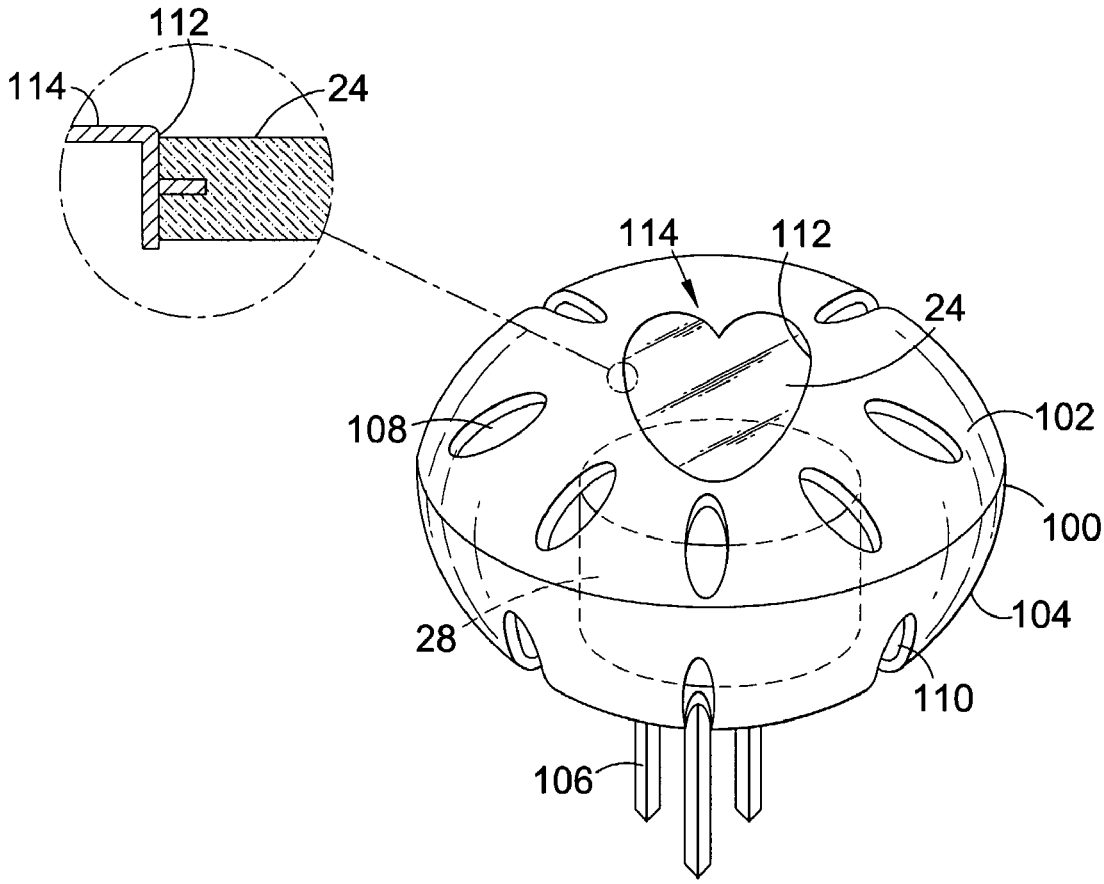
FIG. 7 is a perspective view of an embodiment of the invention for use with a Japanese style toilet cistern.

For Japanese style toilets in which water flows from an open tap into the top of the toilet cistern, the housing may be supported on top of the cistern, on legs for example. The treatment composition of block 28 thus being washed into the cistern. One such embodiment is shown in FIG. 7. A plastics housing is a clam shell type having upper and lower halves

102, 104. Legs 106 depend down from lower housing half 104 to locate the dispenser in the drainage aperture provided on top of a Japanese style toilet cistern, as well known in the art. A solid block 28 rests inside the housing 100 on lower half 104. Apertures 108 allow water to enter the upper half of 102 to contact block 28 and exit through lower half apertures 110. A block 24 of fragrance impregnated gel fills a heart shaped aperture 112 in the upper surface 114 of upper housing half 102. Gel block 24 provides an attractive appearance as well as the perfume fragrance. The perimeter of aperture 112 may be configured as for the perimeter of aperture 9 in the first embodiment with a flange defining the periphery of the aperture 114 and a shoulder extending inwards from the flange for location of the gel block 24 as shown in the detail cross-section in FIG. 7.

Depending on the direction and flow of the flushing water, the arrangement of apertures shown is intended to be used with most commercially available toilets, but it will be appreciated that other arrangements will be possible, including those appropriate to particular types of toilet bowl.

The invention claimed is:

1. A dispenser for releasing a treatment composition into a toilet, and a fragrance into a surrounding room, comprising:

a first block of the treatment composition;

a second block of material impregnated with the fragrance; and a housing with apertures for admitting water into the housing and for allowing the water to drain out of the housing, and having an interior space to house the block of the treatment composition for contact with the water;

the housing holding the fragrance block such that the fragrance block is positioned in an opening in a wall of the housing and allows one major surface of the fragrance block to be exposed to the exterior of the housing and an opposed major surface of fragrance block to be in fluid communication with the interior space of the housing to allow it to emit fragrance through the housing apertures.

2. A dispenser according to claim 1, in which the housing is a hollow shell and the wall opening has a flange extending inwardly of the shell, the flange supporting an edge of the fragrance block between its opposed major surfaces.

3. A dispenser according to claim 2, in which the flange has a projection extending into the opening for locating the fragrance block.

4. A dispenser according to claim 2, in which the flange has projections extending inwardly of the housing beyond the opposed major surface of the fragrance block, for spacing it apart from the treatment composition block.

5. A dispenser according to claim 1, in which the wall opening is in one side of the housing which is upright in use, and the apertures for admitting water and allowing it to drain are separated from the wall opening so that the fragrance block is not in the direct flow path of water between those apertures.

6. A dispenser according to claim 2, in which the wall opening is in one side of the housing which is upright in use, and the apertures for admitting water and allowing it to drain are separated from the wall opening; and in which the flange shields the edge of the fragrance block from the water.

7. A dispenser according to claim 1, comprising a hanger joined to the housing for removably hanging it from a rim of a toilet bowl.

8. A dispenser according to claim 7, in which the hanger is joined to the housing at a wall which supports the fragrance block.

9. A dispenser according to claim 1, in which the housing has internal plinth formations for supporting a base of the treatment block in use to allow the flow of water underneath it.

10. A dispenser according to claim 1, in which the fragrance block and the wall opening have an irregular outline shape.

11. A dispenser according to claim 1, in which the fragrance block is formed with a decorative pattern on its outer major surface.

12. A dispenser according to claim 1, in which the fragrance block is formed of materials of two or more contrasting colors to form a visible pattern on its outer major surface.

13. A dispenser according to claim 1, in which the housing is a plastic one-piece molding.

14. A dispenser according to claim 13, in which the housing is formed from a hinged clam-shell one-piece plastic molding, one portion of which consists of the wall plugged by the fragrance block.

15. A dispenser according to claim 1, in which the fragrance block comprises a gel.

16. A dispenser according to claim 15, in which the gel comprises a polymer matrix having the fragrance dispersed therein.

17. A dispenser according to claim 16, in which in use the gel plugs the wall opening and shrinks as the fragrance evaporates but continues to plug the wall opening.

18. A dispenser according to claim 1 in which the treatment composition comprises one or more of a colorant, a surfactant and a bleach.

19. A method of manufacture of a dispenser according to claim 1, comprising producing the housing and molding the second block of fragrance material into the wall opening.

20. A method according to claim 19, including loading the housing with the first block of the treatment composition.

21. A method according to claim 19, in which the housing is formed from a hinged clam-shell one-piece plastic molding, one portion of which consists of the wall having the wall opening plugged by the fragrance block, comprising closing the clam-shell molding around the fragrance block, about its hinge, to secure it together.

22. A dispenser for releasing a treatment composition into a bowl of a toilet, and a fragrance into a surrounding room, comprising:

a first block of the treatment composition;

a second block of material impregnated with the fragrance; and a housing configured externally to be hung, in use, from the rim of the toilet, and with apertures for admitting water into the housing when the toilet is flushed and for allowing the water to drain out of the housing into the bowl, and having an interior space to house the block of the treatment composition for contact with the water;

the housing holding the fragrance block such that the fragrance block plugs an opening in a wall of the housing and allows one major surface of the fragrance block to be exposed to the exterior of the housing and an opposed major surface of fragrance block to be in fluid communication with the interior space of the housing to allow it to emit fragrance through the housing apertures.

* * * * *